US005158378A

United States Patent [19]

Takada et al.

[11] Patent Number: 5,158,378

[45] Date of Patent: Oct. 27, 1992

[54] PRINTING APPARATUS

[75] Inventors: Katsumi Takada; Kazuhiro Kakuguchi; Hirozi Uchimura, all of Kawasaki, Japan

[73] Assignee: Fujitsu Limited, Kawasaki, Japan

[21] Appl. No.: 863,375

[22] Filed: Apr. 3, 1992

Related U.S. Application Data

[63] Continuation of Ser. No. 663,766, Mar. 1, 1991, abandoned, which is a continuation of Ser. No. 460,477, Jan. 3, 1990, abandoned.

[30] Foreign Application Priority Data

Jan. 12, 1989 [JP] Japan ..... 1-5601
Mar. 10, 1989 [JP] Japan ..... 1-59441

[51] Int. Cl.[5] ..... B41J 3/02

[52] U.S. Cl. ..... 400/124; 400/139; 400/642; 400/645; 400/690; 400/690.1

[58] Field of Search ..... 400/32, 48, 693, 694, 400/636, 636.3, 637.1, 637.2, 638, 639, 639.2, 619, 642, 643, 645, 645.4, 645.5, 647, 689, 139, 143, 160, 161, 166, 124

[56] References Cited

U.S. PATENT DOCUMENTS

| | | | |
|---|---|---|---|
| 1,568,338 | 1/1926 | Kurowski | 400/690 |
| 3,912,069 | 10/1975 | Faulhaber | 400/639.1 |
| 4,024,942 | 5/1977 | Kawaji | 400/642 |
| 4,362,409 | 12/1982 | Endo et al. | 400/642 |
| 4,452,543 | 6/1984 | Adkisson et al. . | |
| 4,483,635 | 11/1984 | Wisner et al. | 400/639 |
| 4,723,857 | 2/1988 | Yokoi | 400/689 |
| 4,806,035 | 2/1989 | Maeda | 400/647.1 |
| 4,848,941 | 7/1989 | Imaseki | 400/690.4 |
| 4,943,173 | 7/1990 | Okazaki et al. | 400/689 |

FOREIGN PATENT DOCUMENTS

| | | | |
|---|---|---|---|
| 0202204 | 11/1986 | European Pat. Off. | 400/642 |
| 0270030 | 6/1988 | European Pat. Off. . | |
| 0180867 | 9/1985 | Japan | 400/605 |
| 0029575 | 2/1986 | Japan | 400/690.1 |
| 0143162 | 6/1986 | Japan | 400/642 |
| 0208966 | 9/1987 | Japan | 400/642 |
| 2202191A | 9/1988 | United Kingdom . | |
| 8203823 | 11/1982 | World Int. Prop. O. | 400/637.2 |

OTHER PUBLICATIONS

IBM Technical Disclosure Bulletin, "Positive-Acoustic Seal", vol. 23, No. 6, Nov. 1980, p. 2357.

Patent Abstracts of Japan, vol. 10, No. 381, Dec. 19, 1986.

*Primary Examiner*—Eugene H. Eickholt
*Attorney, Agent, or Firm*—Armstrong & Kubovcik

[57] ABSTRACT

In an impact type printing apparatus, leak of impact noise to outside can be reduced by (1) arranging the print head, platen and sheet exhaust port almost in a line and (2) setting the shape of guide ribs provided at the internal surface of cover having the aperture so that the envelope of guide ribs which has come closest to the platen at the center and periphery thereof of the sheet and is gradually separated from the platen at both ends of the sheet. Moreover, the optimum exhaust port can be selected depending on the type and thickness of sheet by rotation of cover or providing the slide mechanism.

3 Claims, 13 Drawing Sheets

FIG.10(a)
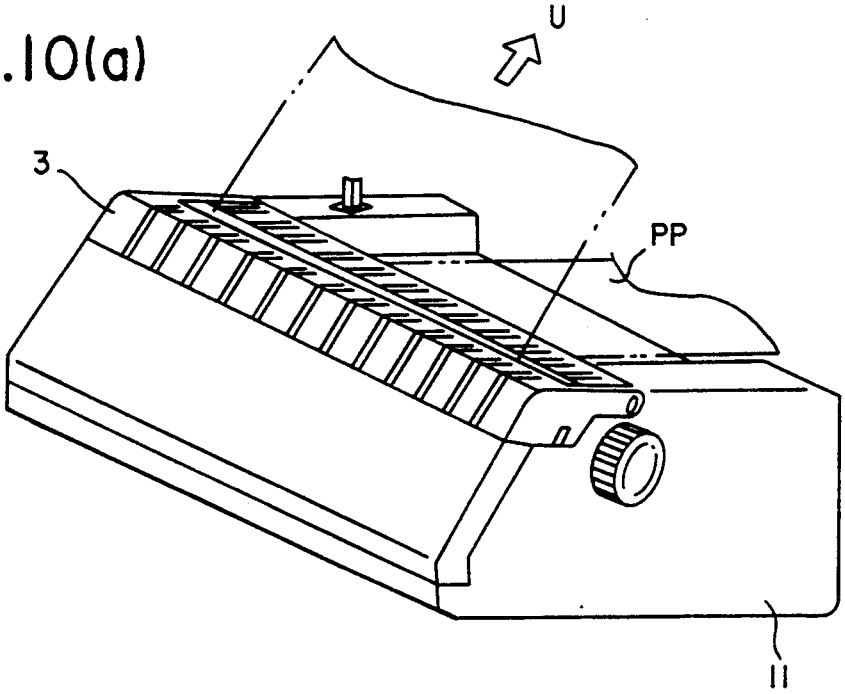
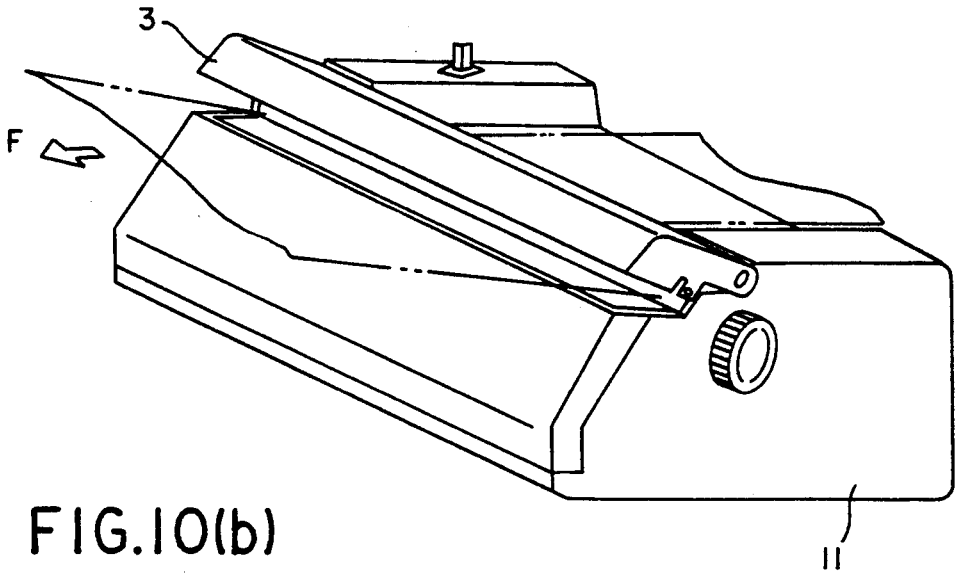
FIG.10(b)

FIG.12(a)
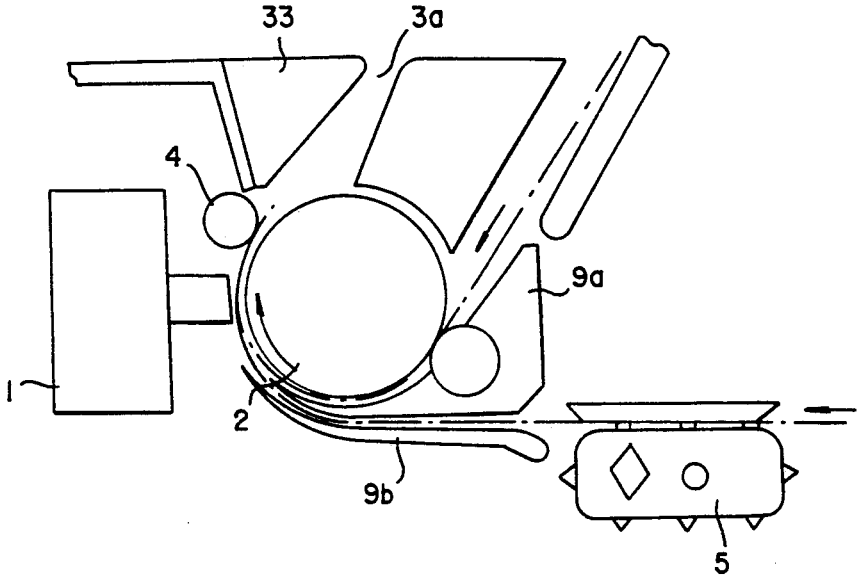
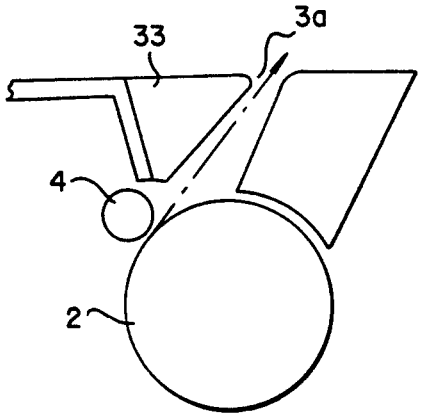
FIG.12(b)
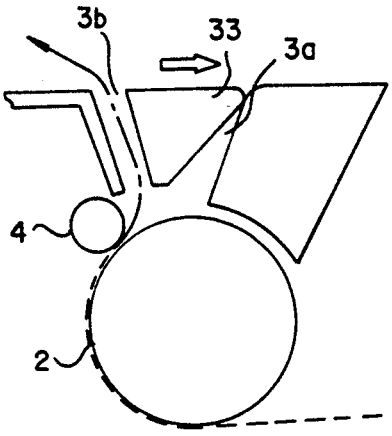
FIG.12(c)

FIG.14(a)
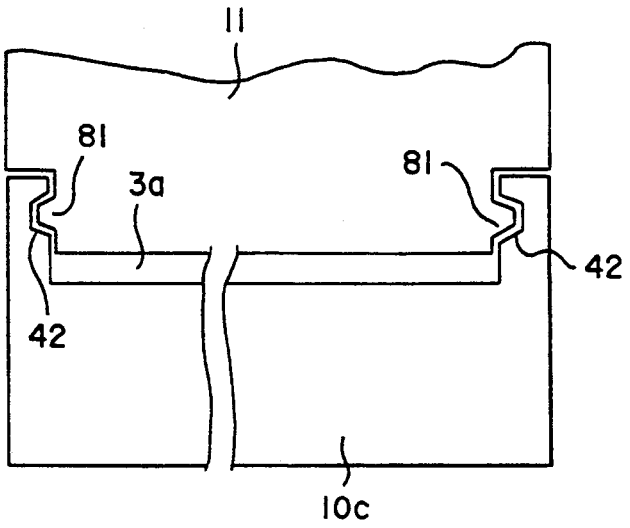
FIG.14(b)
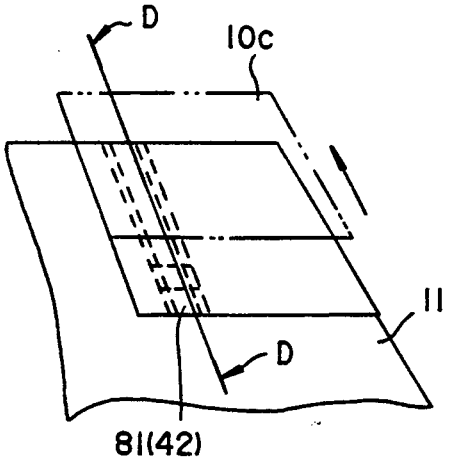
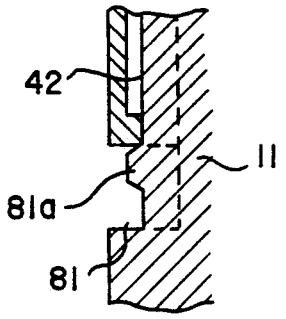
FIG.14(c)
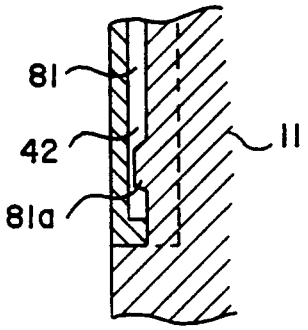
FIG.14(d)

PRINTING APPARATUS

This application is a continuation of application Ser. No. 663,766 filed Mar. 1, 1991, now abandoned which in turn is a continuation of application Ser. No. 460,477, filed Jan. 3, 1990, now abandoned.

BACKGROUND OF THE INVENTION (1) Field of the Invention

The present invention relates to an improvement of a printing apparatus which conducts printing by giving impact to a printing medium set on the platen with a print head and then ejects the printing medium from an exhaust port.

An impact printer such as a wire dot-matrix printer is already used widely because of its low-cost characteristics and duplicating function.

However, such impact printer generates impact noise during the printing operation and such impact noise is considered as a problem of this printer. Recently, the printing apparatus has often been installed in offices as an output device of a personal computer, etc. and therefore it has also been intensively requested to reduce the level of printing noise. Particularly, the front end noise of the printer results in a serious problem because an operator usually stays in front of the printer.

It has of course been discussed how to suppress the impact noise generated during printing operation by improvement of the print head itself, but the method to suppress impact noise is naturally has a limitation. Therefore, it is also necessary, from the structural view point of apparatus, to realize reduction of impact noise.

Meanwhile, it is also impressively expected that a printing apparatus accepts a variety of printing media, such as papers in different thickness and rigidity, for example, an ordinary paper and paper-stapled sheet [a plurality of papers are gathered and bound with a pressing force thereto].

(2) Description of the Prior Art

FIGS. 1(*a*), 1(*b*) respectively show conventional printers. In the printer shown in FIG. 1(*a*), an aperture 3*a* designed as the exhaust port for papers is provided above the platen 2 and a print head is also provided at the left side of platen 2.

The print head 1 makes spacing movement along the platen 2 to execute the printing on a cut sheet inserted from the guide 6 or a continuous sheet transferred by a tractor 5. A bail roller 4 for pressing the paper is provided between the print head 1 and a top cover 3 provided at the upper part of print head 1. This bail roller 4 moves in the direction indicated in the figure to cause the paper running toward the direction of arrow mark A to move toward the direction of arrow mark B and then exhaust the paper from the aperture 3*a*.

A sound insulation material 7 is provided at a part other than the neighborhood of bail roller 4 of the top cover 3.

In the printer having such structure, the impact noise of print head is suppressed by the sound insulation material 7 of the top cover 3 as much as not leaking to the front side of printer.

On the other hand, in the horizontal type printer as shown in FIG. 1(*b*), an aperture 3 which is designed as the exhaust port of paper is provided in the left side of platen 2 and the print head 1 is provided at the lower part of platen 2. The cut sheet (SP) from the guide 6 or the continuous sheet (LP) transferred by the tractor 5 is transferred almost horizontally and exhausted forward from the aperture 3*a* provided at the front side of apparatus after completing the printing by the print head.

In the printer as shown in FIG. 1(*a*), since the aperture 3*a* is provided at the upper part of platen 2, the printing result on the paper exhausted therefrom can be checked easily. However, the print head 1 is provided at the lower part of the top cover 3 to result in the problem that it becomes near the cover aperture 3*a*, noise of print head 1 leaks easily therefrom and resultant forward noise becomes high level.

Moreover, since a movable bail roller 4 is provided above the print head 1, the sound insulating material 7 is not provided to this part of the top cover 3. Accordingly, sufficient sound insulation effect by the top cover 3 cannot be obtained in this case, resulting in a problem that the forward noise level cannot be lowered.

In the case of a printer shown in FIG. 1(*b*), the aperture 3*a* is provided at the front area of apparatus and the print paper is exhausted with the printing (front) side placed rear side. Therefore, it is difficult to check the printing result. In addition, the forward noise level is high because the impact noise of print head 1 is released forward in direct.

From the point of view of a kind of paper to be used, thickness and rigidity are different from the paper to paper in accordance with a kind of paper. Therefore, a printer as shown in FIG. 1(*a*), FIG. 1(*b*) having the one exhaust path and the one exhaust direction cannot realize smooth transfer of paper for every kind of paper without occurrence of sheet jamming and improper line feeding.

SUMMARY OF THE INVENTION

It is an object of the present invention to improve a printing apparatus which suppresses forward print noise while keeping the condition to easily check the printed paper.

It is another object of the present invention to improve a printing apparatus which smoothly transfer and exhaust a variety of media.

These objects can be achieved by executing following procedures (1) to (5).

(1) An aperture is provided to the upper part of platen, while the print head to the lower part of platen and a platen is arranged between the aperture and print head.

(2) A sound absorbing material or sound insulating material is provided at the inner surface of cover having the aperture.

(3) A stationary type bail roller is provided above the print head.

(4) A plurality of exhaust ports in different exhausting direction are provided selectably depending on the type of medium by an operator.

(5) The members forming a plurality of exhaust ports in different exhausting direction are provided movably to switch the exhaust port depending on movement of the member.

Namely, the print head is provided at the lower part of platen and therefore becomes far from the aperture at the upper part of platen. Thereby, leak of noise of print head from the aperture can considerably reduced. Moreover, since the platen is provided between the aperture and print head, the platen shows the effect as the sound insulating member and the noise generated by print head is not leaked in direct.

In addition, leak of noise can further be reduced due to the effect of sound absorbing member or sound insulating member provided at the internal surface of cover.

Furthermore, it is no longer necessary to acquire the moving area of bail roller by providing stationarily the bail roller and more sound absorbing members or sound insulating members may be provided at the internal surface of cover.

On the other hand, since a plurality of exhaust ports are provided selectably depending on the type of media, the optimum exhaust path can be selected depending on the medium and the medium can be transferred and exhausted most smoothly. Therefore, forms jamming or improper line feeding can be prevented.

BRIEF DESCRIPTION OF THE DRAWINGS

FIG. 1(*b*) shows a conventional horizontal type printing apparatus in which an aperture is provided in the left side of platen and the print head is provided at the lower part of platen;

FIG. 4(*b*) is a perspective view of a part of the top cover;

FIG. 9(*b*) shows a sectional view along the line A—A in FIG. 9(*a*);

FIG. 10(*a*) is a perspective view of the third embodiment in which the top cover of the printing apparatus is closed;

FIG. 10(*b*) is a perspective view of the third embodiment in which the top cover of the printing apparatus is opened;

FIG. 12(*a*) shows schematically a structure of the fourth embodiment;

FIG. 12(*b*) is a diagram showing that a switching member has moved to the left side forming the exhaust port in the right side;

FIG. 12(*c*) is a diagram showing that a switching member has moved to the right side forming the exhaust port in the left side;

FIG. 13(*b*) shows schematically a structure of the fifth embodiment;

FIG. 14(*a*) is a plan view observed from the direction B of FIG. 13(*a*);

FIG. 14(*b*) is a side elevation of the part observed from the direction C of FIG. 13(*a*);

FIG. 14(*c*) is a sectional view along the line D—D of FIG. 14(*b*) when the top cover is opened; and FIG. 14(*d*) is a sectional view along the line D—D of FIG. 14(*b*) when the top cover is closed.

DESCRIPTION OF THE PREFERRED EMBODIMENT

Figure 1A:
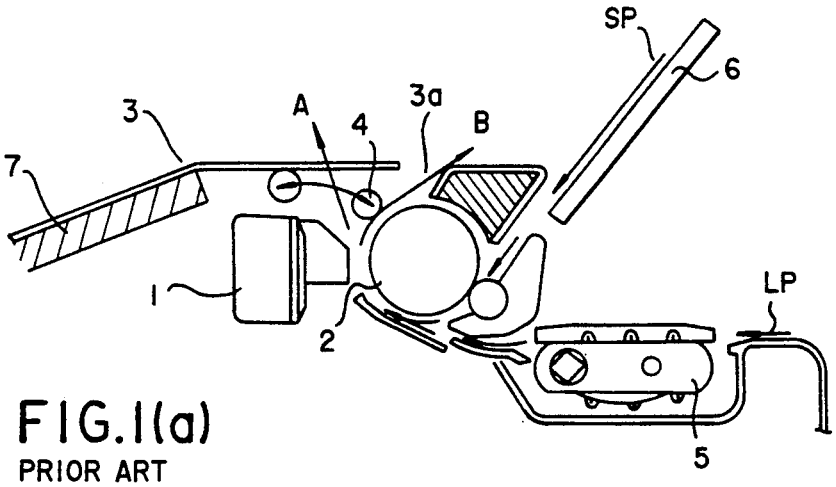
FIG.1(a) PRIOR ART
FIG. 1(*a*) shows a conventional printing apparatus in which an aperture is provided above the platen as the exhaust port of paper and the print head is provided in the left side of platen.
Figure 1B:
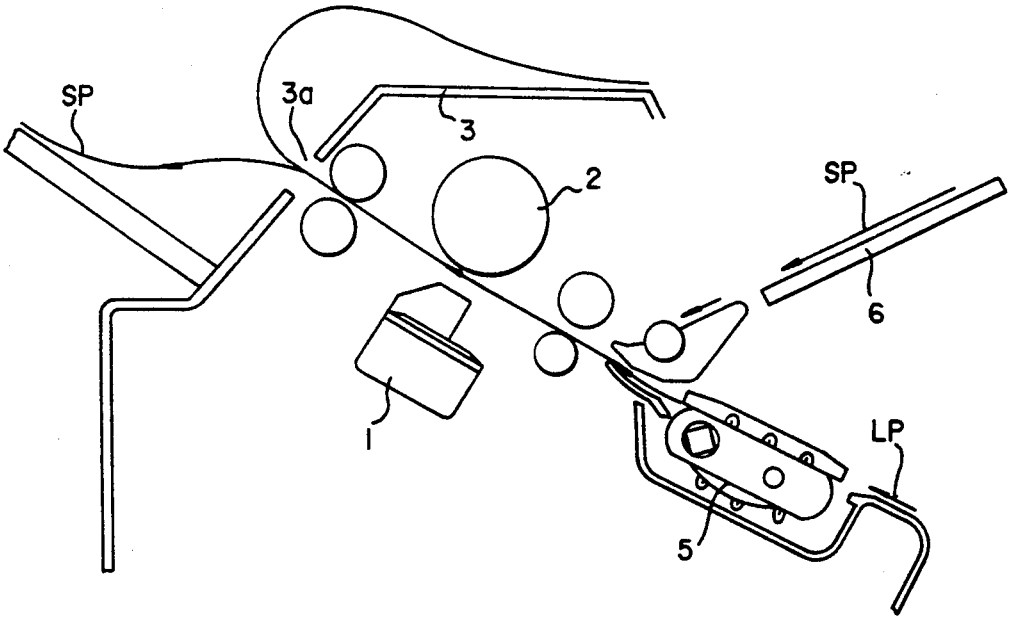
FIG.1(b) PRIOR ART

A preferred embodiment of the present invention will be explained with reference to the drawings from FIG. 2 to FIG. 14.

The like elements are designated by the like reference numerals throughout the drawings.

First embodiment:

FIG. 2~FIG. 5 are diagrams for explaining structure and operations of the first embodiment.

Figure 2:
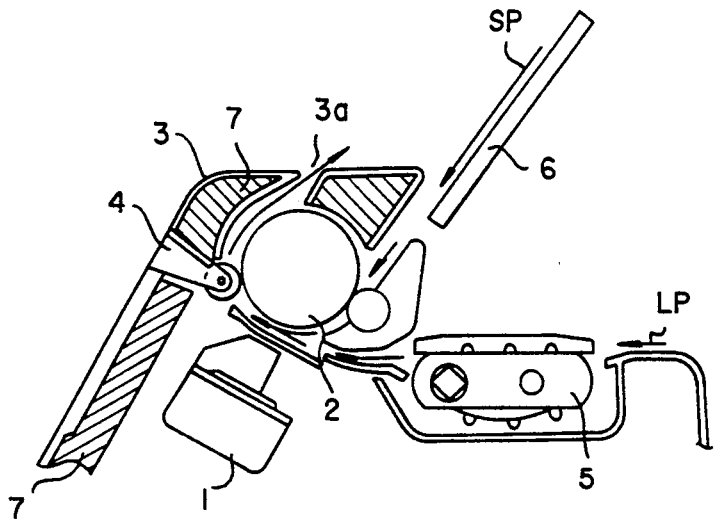
FIG. 2 shows schematically the arrangement of the platen, aperture of top cover and print head in the present invention.

FIG. 2 shows schematically the arrangement of platen 2, aperture 3*a* of the top cover 3 and print head 1 in the printing apparatus. In FIG. 2, the top cover 3 having the aperture 3*a* is provided above the platen 2 and the print head 1 formed by the dot print head is provided with deflection below the platen 2. The print head 1 is located at the position rotated counter-clockwise by 60° around the axis of platen 2 from the horizontal plane including the axis of platen 2 or 30° relative to a vertical axis.

Figure 3:
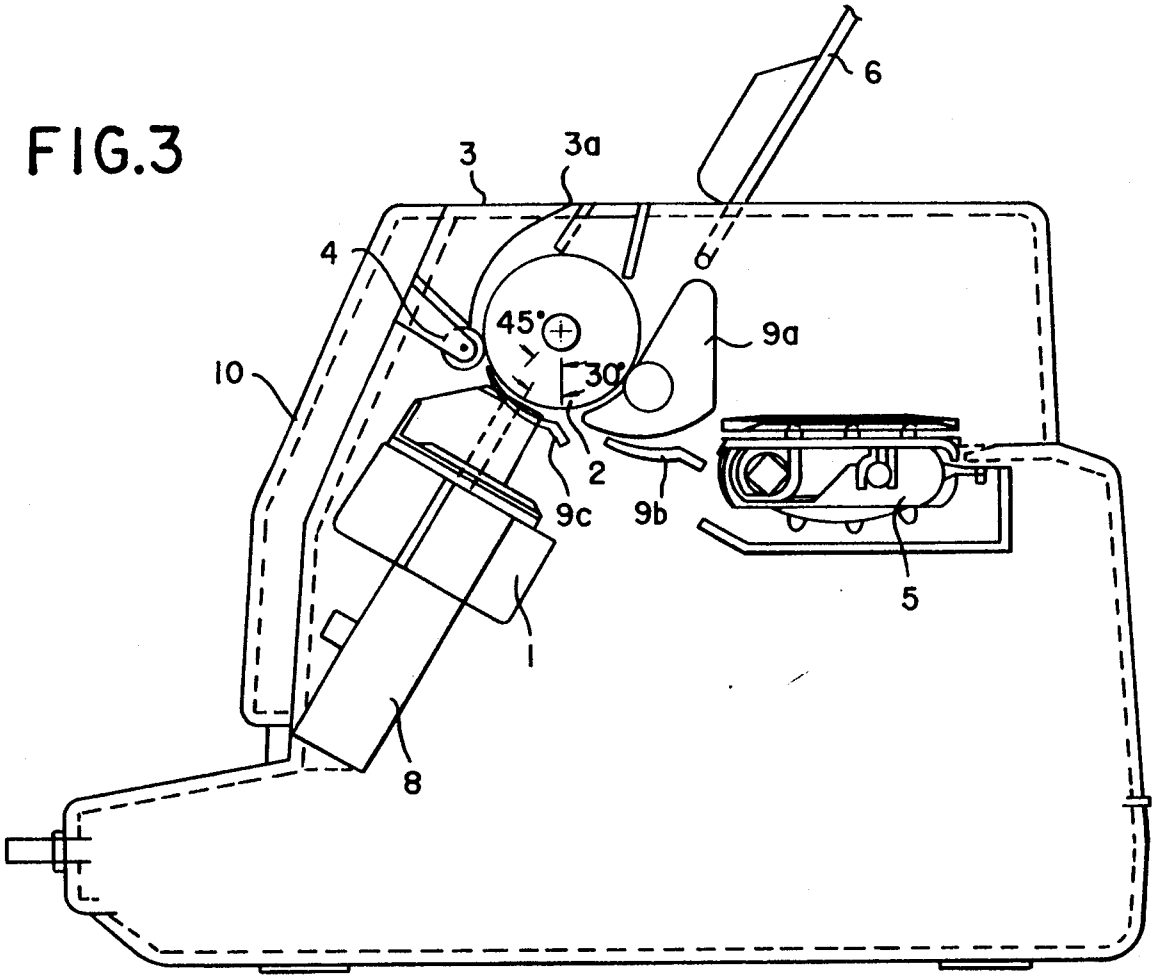
FIG. 3 shows schematically a structure of the first embodiment of the present invention.

FIG. 3 shows schematically a structure of the first embodiment of the present invention. In FIG. 3, the tractor 5 is provided horizontally for making easier the setting of continuous sheet and a sheet guide 9*b* is provided between the platen 2 and the tractor 5. A cut sheet guide 6 is provided with deflection above the platen 2 and a sheet guide 9*a* is provided between the platen 2 and the cut sheet guide 6. Moreover, a sheet guide 9*c* is also provided between the print head 1 and platen 2 and an ink ribbon mechanism 8 is further provided to the print head 1. At the upper part of print head 1, the bail roller 4 is stationarily provided.

Meanwhile, a front cover 10 is provided with inclination in the front side of apparatus along the print head 1 and ink ribbon mechanism 8. The front cover 10 has the sound insulating material 7 at the internal surface thereof and can be opened by rotation around the fulcrum provided at the lower side thereof.

Figure 4A:
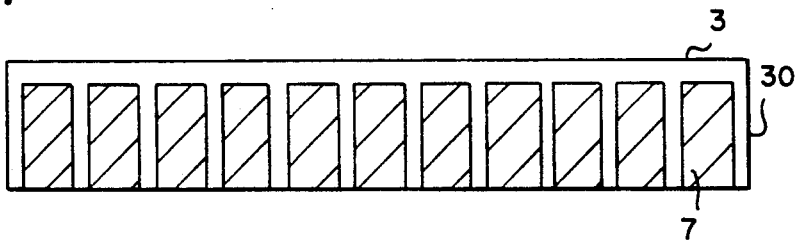
FIG. 4(*a*) shows schematically a structure of top cover.
Figure 4B:
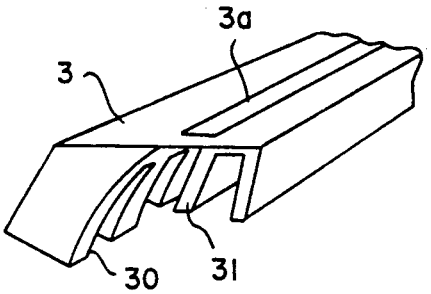

FIGS. 4(*a*), 4(*b*) show schematically a structure of top cover 3. The top cover 3 is provided, as shown in FIG. 4(*b*), with a guide rib 30 and a guide plate 31 for guiding the paper. The aperture 3*a* is provided at the upper surface of top cover 3 and the paper is exhausted through this aperture 3*a*. As shown in FIG. 4(*a*), a sound absorbing or insulating material 7 formed by sponge or rubber plate is provided between the guide ribs 30.

As shown in FIGS. 2 and 3, the print head 1 is provided in a line with the aperture 3*a* through the platen 2. Therefore, the print head 1 is separated from the aperture 3*a* and the platen 2 provided works as the sound insulating material. Thereby direct leak of noise to outside can be prevented.

Moreover, the side surface of print head 1 is covered with the sound insulating material 7 of the front cover 10 and leak of noise through the front cover 10 can be alleviated. Release of noise from the aperture 3*a* and the periphery thereof can be prevented by the sound insulating material 7 provided to the top cover 3.

Operations of the first embodiment will then be explained with reference to FIGS. 3 and 5.

In the case of executing the printing on the cut sheet, a cut sheet guide 6 is erected first obliquely as shown in FIG. 3. The cut sheet is inserted along the cut sheet guide 6 and is wound around the platen 2 by the paper guides 9*a*, 9*c*. The printing is carried out on the cut sheet with space movement of the print head 1. After the printing, the cut sheet transferred along the platen 2 by the bail roller 4 and guide rib 30 of top cover 3 and is exhausted from the aperture 3*a* of the top cover 3. Therefore, the cut sheet has converted its running direction for about 180°.

Figure 5:
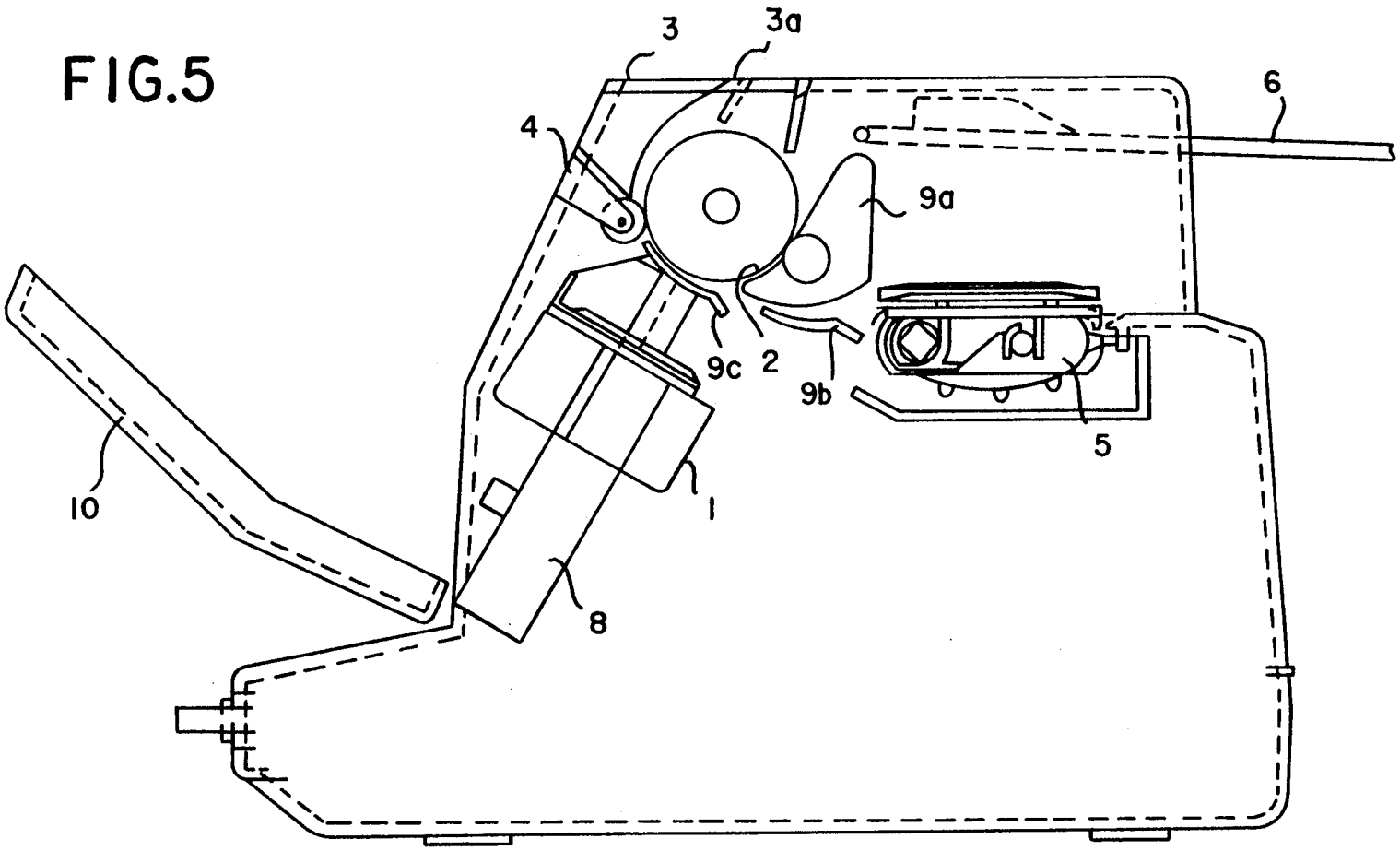
FIG. 5 is a diagram for explaining the continuous printing on the paper with the first embodiment of the present invention.

On the other hand, in the case of a continuous sheet, as shown in FIG. 5, the cut sheet guide 6 is rotated in horizontal and it is used as the stacker. Namely, the continuous sheet being set to the tractor 5 is guided to the platen 2 along the sheet guide 9*b* and the printing is carried out with the space movement of print head 1. The continuous sheet having completed the printing is transferred along the platen 2 by the bail roller 4 and guide rib 30 of top cover 3, exhausted from the aperture 3(*a*) of cover and is stacked by the paper guide 6.

Therefore, the continuous sheet has converted its running direction for about 120°.

As described above, since the print head 1 is provided in the printing apparatus at the area below the platen 2, replacement of ink ribbon 8 and replacement of print head 1 at the time of maintenance cannot be done effectively. Therefore, in order to improve the efficiency of replacement of these elements, the front cover 10 is provided with inclination as shown in FIG. 5 and it can be opened by rotation thereof around the fulcrum at the lower side (not illustrated).

Second embodiment:

In view of further lowering the level of noise generated from the aperture 3(*a*) of the top cover 3, the aperture area must be further reduced. The second embodiment has reduced the area of the aperture by optimizing the shape of guide rib provided at the internal surface of top cover.

Figure 6:
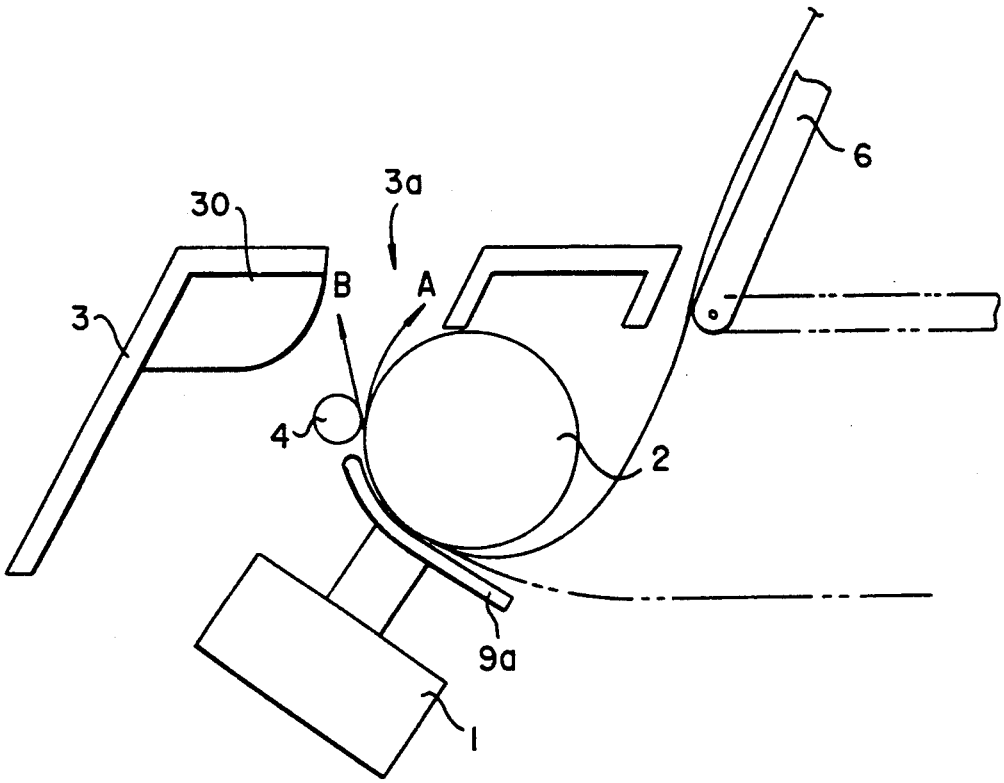
FIG. 6 is a diagram for explaining various exhaust paths depending on the condition and type of papers in case the paper having completed the printing runs toward the exhaust port.

The sheet is guided by the sheet guide 9*c* in such a manner as being wound around the platen 2 for the printing. After the printing, the sheet is then transferred to the aperture 3*a* while it is pressed toward the platen 2 with the pair of bail rollers which are usually provided with a proper space. In this case, a part of the sheet passing through the inside of the pair of bail rollers 4 is transferred to the aperture 3(*a*), under the condition indicated by A, along the platen 2 as shown in FIG. 6. However, a part of the sheet passing through the outside of the pair of bail rollers 4 is transferred to the aperture 3(*a*) facing to the direction different from A under the condition that when the part is nearer to both ends of the sheet, it is gradually separated from the platen 2 and it is most separated from the platen as shown by B. Therefore, in the case of the guide rib 30 in the uniform shape as shown in FIG. 4(*b*), since the both sides of sheet shown by B in FIG. 6 must be exhausted from the aperture 3(*a*) for the reliable exhaustion of the sheet under the condition mentioned above from the aperture 3(*a*), the slot width of aperture 3(*a*) must sufficiently be large. As a result, the noise released becomes higher in level as much as enlargement of slot width.

Figure 7:
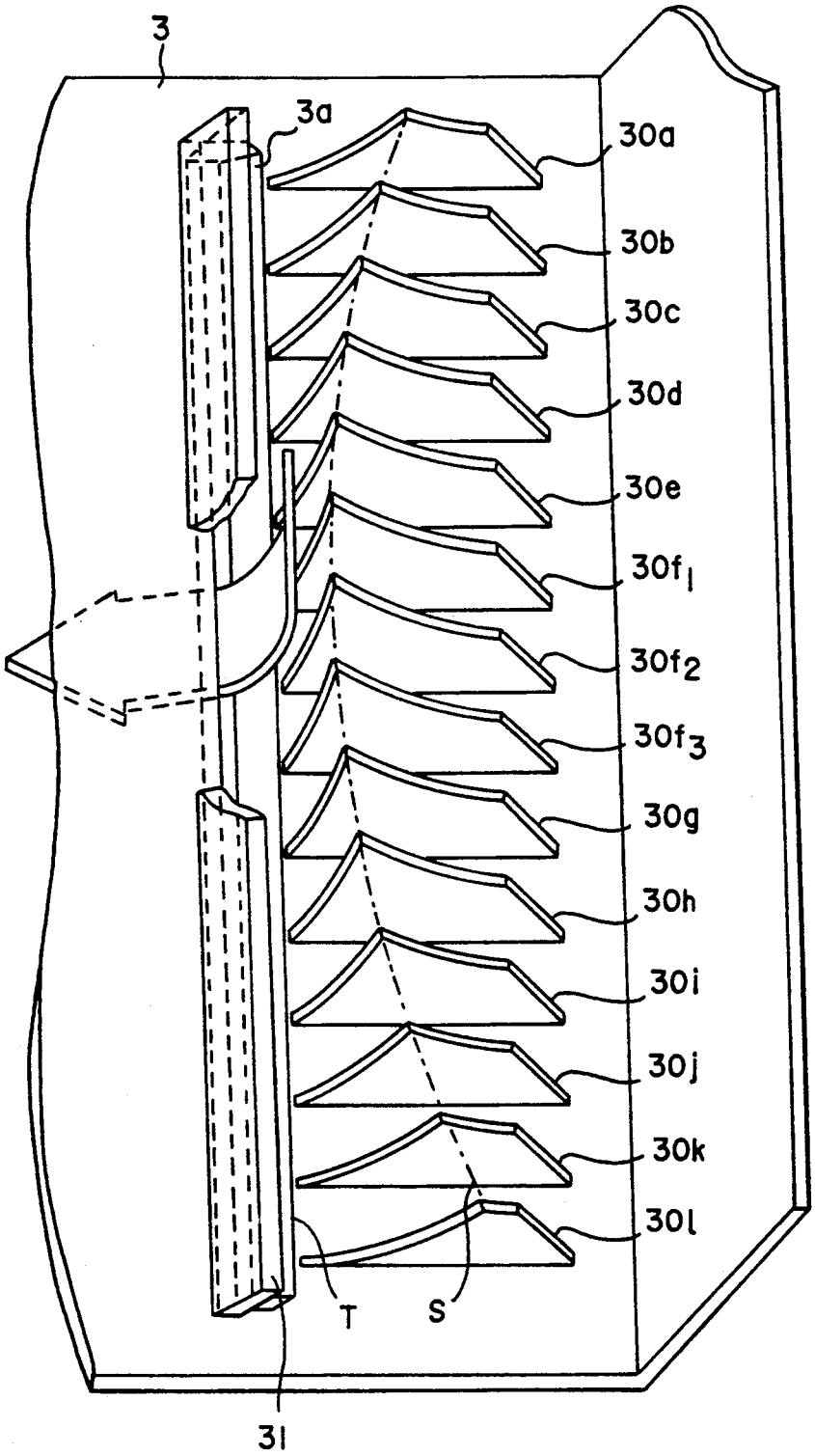
FIG. 7 shows schematically the shape and envelope plane of a guide rib provided to the top cover in the second embodiment.

FIG. 7 is a perspective view schematically indicating the internal surface of top cover 3 providing a plurality of guide ribs 30 of the present invention. In FIG. 7, a plurality of guide ribs 30*a*, 30*b*, 30*c*, 30*d*, . . . , 30*k*, 301 are provided in parallel with the predetermined pitch in the axial direction of the platen 2. The envelope of guide ribs for guiding the papers (the surface including a curve S indicated by a chain line and a side T of the aperture 3*a*) is designed so that it becomes nearest to the platen 2 at the guide ribs $30f_1$, $30f_2$, $30f_3$ near the center corresponding to the area between two bail rollers 4 and is gradually separated from the platen 2 while it moves to the guide rib 30*a* from 30*e* and to 301 from 30*g*.

In case the top cover 3 providing the guide ribs of the shape shown in FIG. 7 is used, the center area of sheet is guided by the guide ribs $30f_1$, $30f_2$, $30f_3$ and both sides of sheet are sequentially guided by the guides ribs from 30*e* to 30*a* and from 30*g* to 301. As a result, both sides of sheet corresponding to guide ribs from 30*e* to 30*a* and from 30*g* to 301 are also guided in the same direction as the center area corresponding to the guide ribs $30f_1$, $30f_2$, $30f_3$ and is reliably exhausted from the aperture 3*a* as indicated by the arrow mark. Therefore, the aperture can be reduced in area in comparison with the case where the guide ribs of the uniform shape are used.

Figure 8:
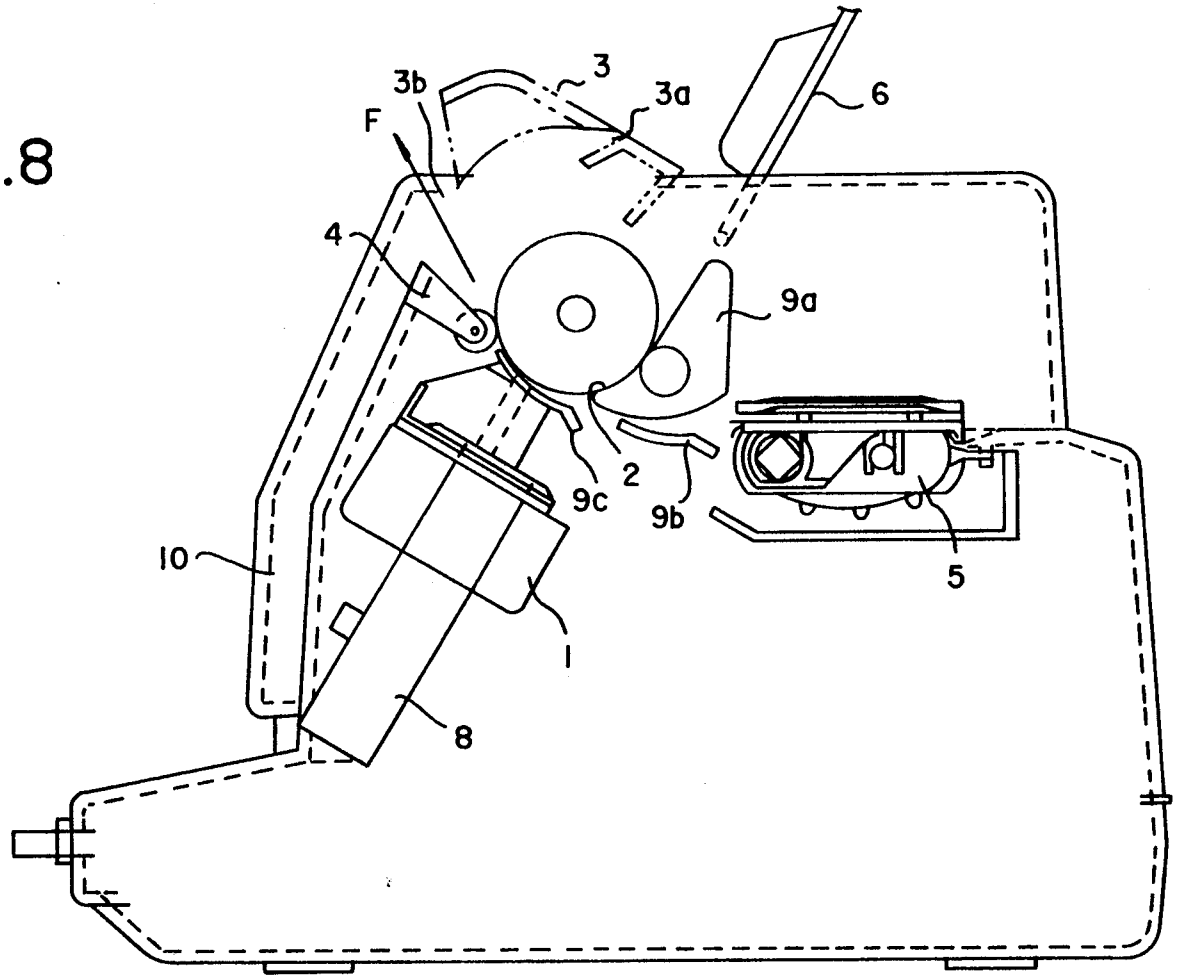
FIG. 8 shows the third embodiment wherein the top cover is opened by rotating it around the axis at the rear end thereof.

Third embodiment:

In case the printing is carried out on the special paper such as an inflexible cut sheet, directional conversion of 180° around the platen 2 gives adverse effect on the printing result. Therefore, as shown in FIG. 8, the mechanism is provided so that the top cover 3 can be opened by rotating around the axis at the rear end of cover 3. This mechanism is illustrated in FIGS. 9(*a*) and 9(*b*).

Figure 9A:
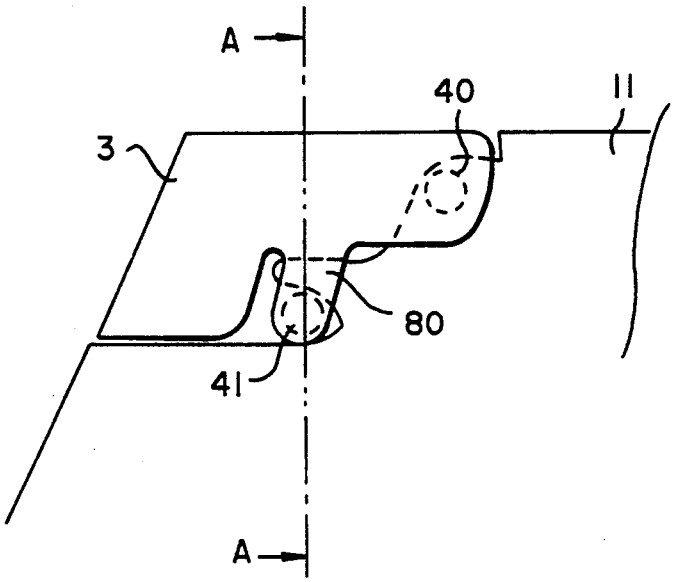
FIG. 9(*a*) shows schematically the side surface of top cover in the third embodiment.
Figure 9B:
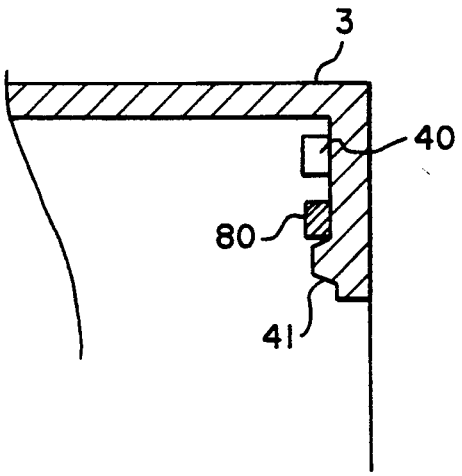

FIG. 9(*a*) shows schematically a side elevation of the top cover 3, while FIG. 9(*b*) shows a sectional view along the line A—A of FIG. 9(*a*). The top cover 3 is so structured as can be rotated around the rotating axis 40 for the main body frame 11 and has a protrusion 41 which is engaged with a protrusion 80 of the main body frame 11. FIGS. 10(*a*), 10(*b*) are perspective views of top cover 3 of the printing apparatus of the third embodiment. In case the printing is carried out on the ordinary paper, the top cover 3 is closed as shown in FIG. 10(*a*). In this case, since the main body frame 11 is formed by a mold material, an engaging protrusion 41 of the top cover 3 can easily be set to the engaging position, as shown in FIGS. 9(*a*) and 9(*b*) by deflecting the mold protrusion 80 of the main bodyframe 11. When the top cover 3 is being closed, the exhaust port 3*b* shown in FIG. 8 is shut and the paper is guided by the guide rib 30 (not illustrated) provided at the internal surface of top cover 3 and is exhausted upward in the direction U from the exhaust port 3*a*.

When the top cover 3 is opened, the engaging protrusion 41 of the top cover 3 can easily be positioned above the mold protrusion 80 as shown in FIG. 9(*b*) by deflecting the mold protrusion 80 of the main body frame 11. This condition is also shown in FIG. 10(*b*). When the top cover 3 is opened, the ex-haust port 3(*b*) is formed in place of the exhaust port 3(*a*) as shown in FIG. 8, the sheet is not guided by the guide rib 30 (not illustrated) provided at the internal surface of top cover 3 and therefore it does not run along the platen 2 and is exhausted in the direction of arrow mark F between the top cover 3 and the bail roller 4. Accordingly, a curvature of inflexible sheet becomes small and smooth exhaustion of paper is carried outgiving no adverse effect on line feeding during the printing. However, in this case, the sound insulation effect by arrangement of print head 1 and cover 3 can be a little deteriorated.

Figure 11:
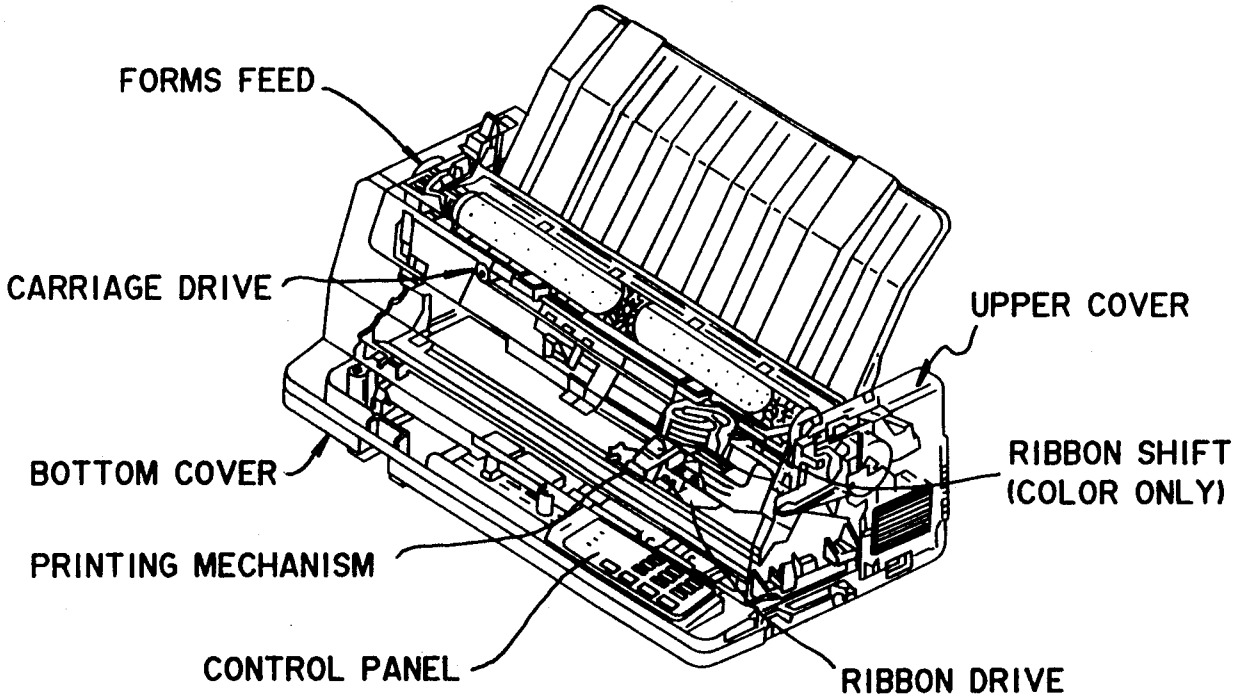
FIG. 11 is a perspective view of the housing and mechanism of the printing apparatus to which the present invention is applied.

FIG. 11 is a perspective view of the housing and mechanism of the printing apparatus to which the present invention is applied.

Fourth embodiment:

The fourth embodiment provides a pair of apertures as the sheet exhaust ports and this embodiment has a structure that any one desired is selected depending on the type of sheet. The structure and operations are explained with reference to FIGS. 12(*a*), 12(*b*) and 12(*c*). FIG. 12(*a*) shows schematically a structure of the fourth embodiment. In this embodiment, a slidable switching member 33 is provided at the upper part of platen 2 to form selectably the pair of exhaust ports 3(*a*), 3(*b*). As shown in FIG. 12(*b*), when the switching member 33 moves to the left side, the exhaust port 3(*b*) is closed and the exhaust port 3(*a*) is formed. Accordingly, the ordinary paper is guided by the guide rib provided to the switching member 33 and is then exhausted from the exhaust port 3(*a*).

Meanwhile, if the paper-stapled sheet is exhausted from the aperture 3(*a*) as shown in FIG. 12(*b*), it is wound around the platen 2, generating layer dislocation between the sheet in the side of the platen 2 and the sheet in the opposite side. In order to prevent such event, the exhaust port 3(*a*) is shut and the exhaust port 3(*b*) is formed by moving the switching member 33 to the right side as shown in FIG. 12(*c*). As a result, the paper-stapled sheet path is formed like the alphabet S. Namely, the sheet has been bent along the platen 2 after the bail roller 4 but exhausted from the exhaust port 3(*b*) through the opposite bending from that by the platen 2. Since the sheet path is formed like an alphabet S, layer dislocation can be prevented.

Here, it is enough that the switching member 33 is formed to be slidable for the main body frame 11. For instance, it is recommended that a part of the switching member 33 engages with the guide groove of the main body frame 11 so that it can slide along the guide groove.

Fifth embodiment:

This embodiment proposes a structure that two kinds of exhaust ports can be formed by sliding the top cover of the printing apparatus.

Figure 13A:
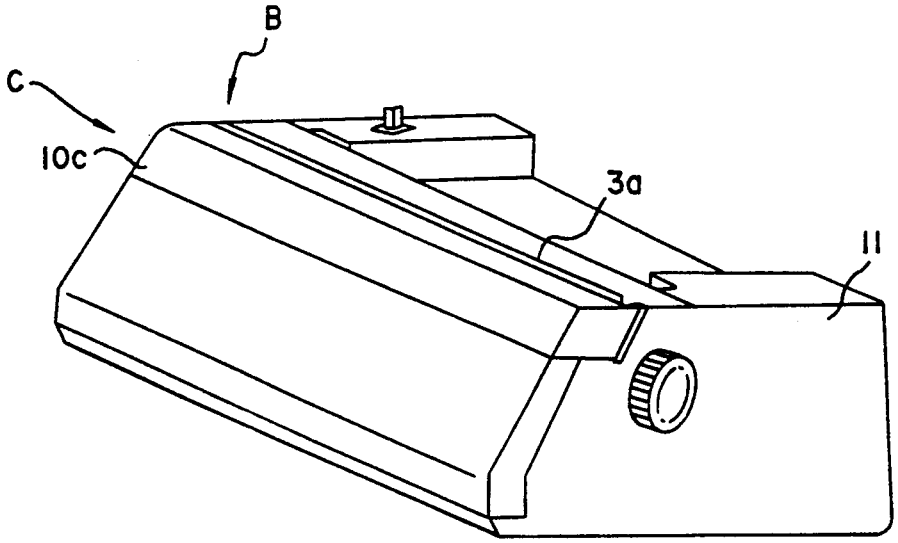
FIG. 13(*a*) is a perspective view showing the outline of the fifth embodiment.
Figure 13B:
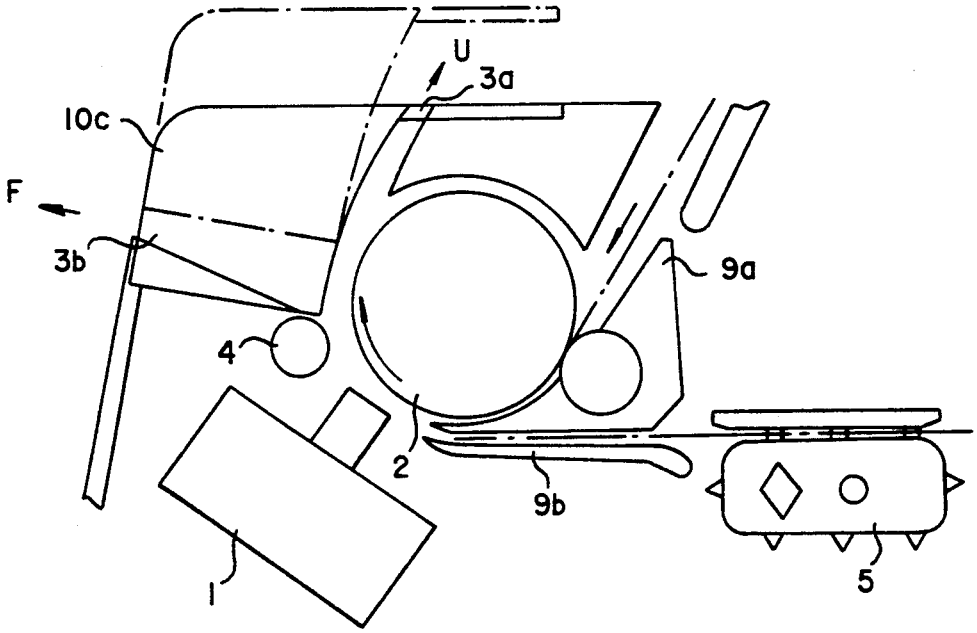

FIG. 13(*a*) is a perspective view of the fifth embodiment and FIG. 13(*b*) is a structural diagram of the fifth embodiment. FIG. 14(*a*) is a plan view observed from the direction B of FIG. 13(*a*); FIG. 14(*b*) is a partial side elevation observed from the direction C of FIG. 13(*a*); and FIGS. 14(*c*), 14(*d*) are sectional views along the line D—D of FIG. 14(*b*).

In FIG. 13(*b*), the front cover 10*c* can slidable in vertical for the main body frame 11. In case the front cover 10*c* is located at the lower position, the first aperture 3(*a*) is formed and when the front cover 10*c* is located at the upper position (indicated by a chain line), the second aperture 3*b* is formed. In FIGS. 14(*a*), (*b*), (*c*), (*d*), a guide rail 81 having an engaging protrusion 81*a* at the intermediate area thereof is provided to the main body frame 11, and meanwhile a guide groove 42 which engages with the guide rail 81 is provided to both side surfaces of the front cover 10*c*.

In case the printing is carried out on an ordinary sheet, the front cover 10*c* is lowered as shown in FIGS. 13(*a*), 13(*b*). In this case, the guide groove 42 of the front cover 10*c* is guided to the lowest part, sliding over the engaging protrusion 81*a*, along the guide rail 81 of the main body frame 11 as shown in FIG. 14(*d*). When the front cover 10*c* is lowered, the second aperture 3*b* is closed as shown by a solid line of FIG. 13(*b*), leaving only the first exhaust port 3(*a*) and the sheet is exhausted from the first aperture 3(*a*).

On the other hand, in case the printing is carried out on a thick sheet or inflexible sheet, the front cover 10*c* is moved upward by sliding as indicated by a chain line in FIG. 12(*b*). In this case, as shown in FIG. 14(*c*), the guide groove 42 of the front cover 10*c* is positioned and stopped sliding over the engaging protrusion 81*a* along the guide rail 81 of the main body frame 11. When the front cover 4*c* is moved upward by the sliding, the second exhaust port 3*b* is formed as indicated by the chain line of FIG. 13(*b*). Therefore, the thick sheet or inflexible sheet is not wound around the platen 1, guided to the second aperture 3(*b*) from the print head 2 and is exhausted from the exhaust port 3(*b*).

In the third and fourth embodiments, the switching member is rotated or moved by sliding to form the aperture for exhausting the sheet, but a method, for example, removal of the switching member itself can also be employed.

Moreover, the exchange of two exhaust ports(aperture) has been explained but the exchange among three or more exhaust ports is also applicable.

The printing mechanism is not limited only to the serial dot printing head and the other printing mechanism such as the line impact print head, so long as it is an impact type, can also be used.

What is claimed is:

1. An impact type printing apparatus having a transfer mechanism for transferring printing sheets and a print mechanism for printing on said printing sheets, said printing apparatus comprising:

(1) a platen for supporting a printing sheet;

(2) a cover enclosing a part of a front side of said printing apparatus and providing means for easily checking a printed sheet and one aperture for exhausting said printed sheet, said aperture being located higher than said platen in said printing apparatus; and (3) an impact print head for printing on said printing sheet, said impact print head being located at a position lower than said platen in said printing apparatus and on a line passing through said one aperture and said platen and disposed at an angle of less than 45° relative to a vertical, whereby said platen is provided between said impact print head and said one aperture to suppress direct transmission of impact print head noise through said one aperture.

2. A printing apparatus according to claim 1, wherein a material reducing sound transmission is provided on a surface of said cover facing said platen.

3. A printing apparatus according to claim 1, wherein a bail roller mechanism for pressing the printing sheet to the platen is fixed to a surface of said cover facing said platen.

* * * * *